US005720271A

United States Patent [19]

Hauser

[11] Patent Number: 5,720,271

[45] Date of Patent: Feb. 24, 1998

[54] PROCESS FOR THE ORIENTATION OF SINGLE CRYSTALS FOR CUTTING IN A CUTTING MACHINE AND DEVICE FOR PRACTICING THIS PROCESS

[76] Inventor: Charles Hauser, Chemin Nuyerattes, 1261 Genolier, Switzerland

[21] Appl. No.: 634,801

[22] Filed: Apr. 19, 1996

[30] Foreign Application Priority Data

Apr. 22, 1995 [CH] Switzerland ..... 1135/95
Apr. 22, 1995 [CH] Switzerland ..... 1136/95

[51] Int. Cl.[6] ..... B24D 3/00

[52] U.S. Cl. ..... 125/28; 125/16.02; 125/13.01; 451/460; 378/73

[58] Field of Search ..... 125/28, 16.02, 125/13.01; 457/460; 29/559; 437/226; 378/73–81; 117/201

[56] References Cited

U.S. PATENT DOCUMENTS

| | | | |
|---|---|---|---|
| 2,858,730 | 11/1958 | Hanson . | |
| 4,710,259 | 12/1987 | Howe et al. | 378/73 |
| 5,099,820 | 3/1992 | Stricot | 125/16.02 |
| 5,187,729 | 2/1993 | Ibe et al. | 378/73 |
| 5,201,305 | 4/1993 | Takeuchi | 125/16.02 |
| 5,269,285 | 12/1993 | Toyama et al. | 125/16.02 |
| 5,575,189 | 11/1996 | Kiuchi et al. | 125/16.02 |

FOREIGN PATENT DOCUMENTS

| | | | |
|---|---|---|---|
| 27 52 925 | 5/1979 | Germany . | |
| 406089887 | 3/1994 | Japan | 451/73 |
| 406229953 | 8/1994 | Japan | 451/73 |

*Primary Examiner*—Robert A. Rose
*Assistant Examiner*—George Nguyen
*Attorney, Agent, or Firm*—Young & Thompson

[57] ABSTRACT

A positioning process and device (1) for a single crystal (2) for cutting in predetermined directions avoids the adjustment of the cutting machine and minimizes the cutting time by positioning outside of the machine, according to rotational angles (d,g) obtained mathematically from measured and/or imposed data, and which positions the geometric single crystal in a plane perpendicular to the cutting direction (z'") while bringing the cutting plane of the single crystal (2) parallel to the direction of cutting of the machine. The device for practicing the method comprises a frame (5), two cylinders (8) mounted rotatably on the frame and supporting the single crystal (2) and a rotatable plate (12) adapted to maintain the cutting support (3) belonging both to the positioning device (1) and the cutting machine. By a raising mechanism (14), the support (3) and the single crystal (2) are placed in contact and fixed to each other after having effected their predetermined relative orientation by rotation about the axes x and z'". The process and the device permit obtaining exact positioning of the single crystal (2) outside the machine under desirable conditions, a very precise and rapid cutting, and an increase in productivity.

7 Claims, 5 Drawing Sheets

FIG. 3A
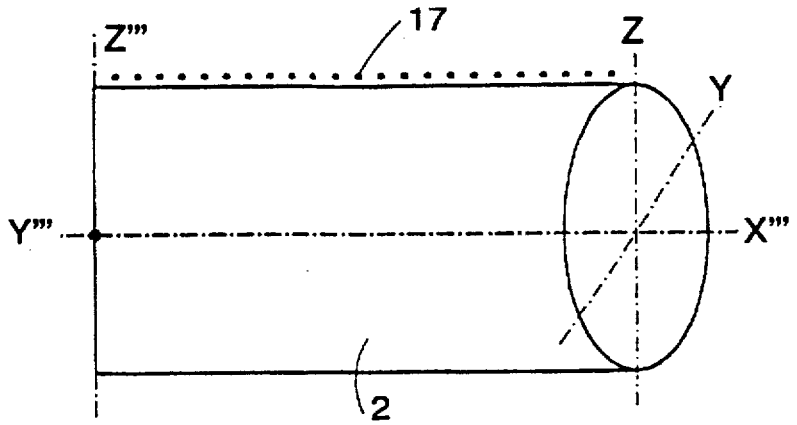
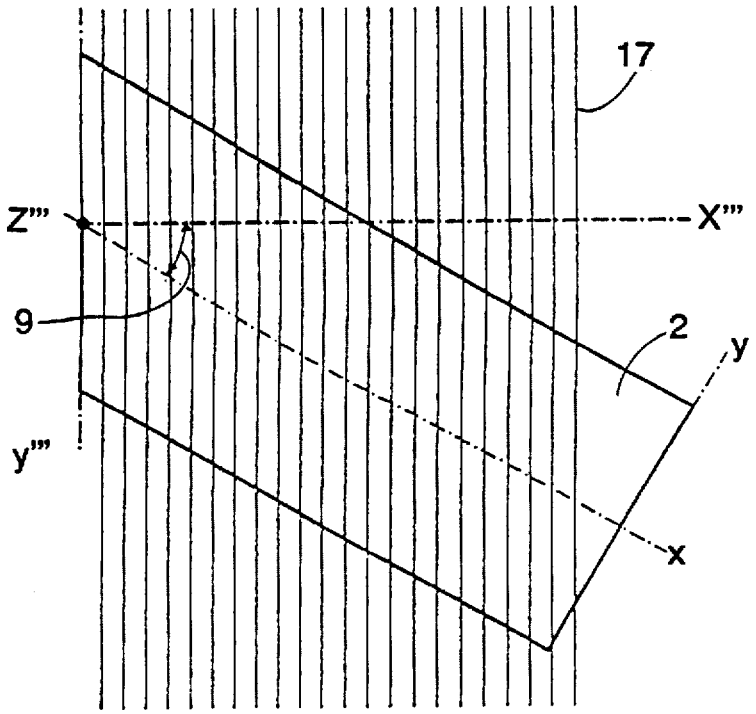
FIG. 3B

PROCESS FOR THE ORIENTATION OF SINGLE CRYSTALS FOR CUTTING IN A CUTTING MACHINE AND DEVICE FOR PRACTICING THIS PROCESS

FIELD OF THE INVENTION

The present invention relates to a process for the orientation of single crystals for their cutting in a cutting machine along a predetermined cutting plane:

BACKGROUND OF THE INVENTION

Single crystals for optical or semiconductor uses ordinarily require that these be cut along very precise orientations relative to the axes of the crystal lattice. Moreover, their production does not permit controlling perfectly the orientation of the axes of the crystal lattice relative to the geometric axes. It is therefore necessary that, in order for the cutting to be correct, to correct on the one hand the production error and on the other hand to take account of the angles formed between the cutting plane and the crystal plane which is selected or imposed by subsequent processes or uses. Given that the cutting is effected on a geometric single crystal, it is necessary to position and maintain it spatially such that the displacement of the cutting system will be parallel to the desired cutting plane. There exists an infinite number of possible positions, however there are only four which can position the single crystal in a plane perpendicular to the cutting plane of the machine. The positioning of the single crystal in one of these four positions therefore permits cutting not only in the desired orientation but also to minimize the cutting time and hence to improve the productivity of the cutting device.

Devices for orienting single crystals are already known and used in the semiconductor industry on internal diameter sectioners or on wire saws. Positioning is effected with an orientable table y'", z'" mounted directly on the machine. An adjustment is made after optical or X-ray measurement. The correction is then introduced according to y'", z'". This procedure has the disadvantage on the one hand of having a position of the single crystal which is inclined relative to the path of the cutting element, which is very unfavorable in the case of a wire saw, in which the plane of the wire must be parallel to the geometry of the single crystal, and on the other hand of not minimizing the length of the cut, which is then unfavorable for saws of internal diameter, decreasing their productivity. Moreover, this manner of processing requires adjusting the machine table before each cut in a very precise manner and in an industrial environment which is often contaminated and hence unsuitable to this type of operation. The adjustment time of the machine also contributes to reduced productivity.

OBJECT OF THE INVENTION

The present invention has for its object to overcome the mentioned drawbacks and to permit precise adjustment of the position of the single crystal in a clean environment and to increase productivity of cutting.

The invention is characterized to this end by the fact that the single crystal is oriented by means of a positioning device separate from the cutting machine according to a predetermined orientation relative to a cutting support, that the single crystal is secured according to said predetermined orientation on the cutting support whose positioning in the cutting machine is geometrically defined relative to the cutting plane of the machine, and in that the cutting support is positioned after securement of the single crystal in the cutting machine according to said geometric positioning defined to obtain said predetermined orientation of the single crystal in the cutting machine.

With these characteristics, it is possible to obtain a precise positioning and orientation of the single crystal in a suitable measuring environment, without the need to effect any adjustment of the position on the cutting machine. The downtime of this latter can thus be considerably decreased so as to increase productivity.

In a preferred embodiment, the invention is characterized by the fact that said predetermined orientation is obtained by positioning the single crystal on the positioning device such that one of its geometric axes of the geometric shape of the single crystal will be comprised in a reference plane corresponding to the working plane of the cutting machine perpendicular to the cutting plane, by effecting a rotation of the single crystal from a first predetermined angle about said geometric axis to bring the normal to the cutting plane of the single crystal into said reference plane, and by effecting a relative rotation between the cutting support and the single crystal through a second predetermined angle about an axis perpendicular to said reference plane such that the normal to the cutting plane will be oriented in a reference direction corresponding to the normal in the cutting plane of the machine, said geometric axis and normal to the cutting plane of the single crystal being comprised in the reference plane.

There is thus overcome in a simple and precise manner the disadvantage of having a position of the single crystal inclined relative to the direction of advance of the cutting elements of the machine, which is particularly unfavorable in wire saws. The principal geometric axis of the single crystal can thus be oriented perfectly parallel to the working plane or to the plane of the wire, thereby obtaining optimum cutting whilst minimizing the length of the cut.

Preferably, the process is characterized in that the orientation of the cutting plane of the single crystal is defined relative to the crystal lattice, in that the orientation of the crystal lattice is measured relative to the geometric shape of the single crystal, and in that the first and second angles of rotation are calculated having regard for the orientation of the cutting plane relative to the crystal lattice and relative to the geometric shape of the single crystal.

By these characteristics, there is obtained a high precision of positioning and a very rapid mounting.

The process according to the invention is applicable with particular advantage to the use of a single crystal whose geometric shape is substantially circularly cylindrical, said geometric axis corresponding to the principal axis of the single crystal and by positioning the single crystal on two parallelly mining cylinders of the positioning device, the axes of the two cylinders being parallel to said reference plane.

The invention is also applicable to a device for practicing the process which is characterized by the fact that it comprises a positioning device adapted to orient the single crystal outside the cutting machine in a predetermined orientation relative to a cutting support on which the single crystal is adapted to be secured and whose emplacement in the cutting machine is geometrically defined and whose principal axes are parallel to the axes of the cutting machine.

This device for practicing the process is preferably characterized in that it comprises first means to support the single crystal in an orientation such that one of the geometric axes of the geometric shape of the single crystal is included in a reference plane corresponding to the working plane of the cutting machine and to effect a rotation of the single crystal from a first predetermined angle about said geometric axis to bring the normal to the cutting plane of the single crystal into said reference plane and second means to effect relative rotation between the cutting support and the single crystal from a second predetermined angle about an axis perpendicular to the reference plane until the normal to the cutting plane is oriented in a reference direction corresponding to the normal to the cutting plane of the machine, and in that it comprises third means to effect a relative translatory movement between the single crystal and the cutting support adapted to bring the cutting support and the single crystal together so as to secure this latter on the cutting support, in said predetermined orientation.

Thanks to these characteristics, there is obtained a rapid and precise positioning adapted to cutting machines permitting exact cutting in a minimum of time. Moreover, the cutting precision will be independent of the machine used or of the operator in the case of production lines.

A preferred embodiment is characterized by the fact that the first means comprise two parallel cylindrical supports mounted rotatably on a frame of the positioning device and arranged so as to support the single crystal and a first angular measurement member adapted to determine the first predetermined angle of rotation, in that the second means comprise a rotatable plate mounted to turn relative to said frame and whose principal plane is parallel to the axes of said cylindrical supports, this rotatable plate being arranged so as to maintain the cutting support in a predetermined geometric position, a second angular measuring member being provided to determine said second predetermined angle of rotation, in that the third means comprise a translation mechanism permitting bringing together the cutting support and the single crystal, and in that the cutting support is so shaped that its positioning in the cutting machine takes place in a geometric position corresponding to the geometric position defined on said rotatable plate such that the reference plane and the reference direction correspond to the working plane and to the normal to the cutting plane of the machine.

These characteristics permit a construction of the positioning device which is particularly simple and uncomplicated, whilst ensuring high cutting precision.

BRIEF DESCRIPTION OF THE DRAWINGS

Other advantages will become apparent from the description given hereafter of the invention in greater detail with the help of drawings representing schematically and by way of example one embodiment.

FIGS. 3A and 3B show, in two orthogonal views, the position of the single crystal obtained according to the present invention.

DETAILED DESCRIPTION OF THE PREFERRED EMBODIMENT

Generally speaking, the invention permits installing on the cutting machine single crystals preoriented, whose curing plane is oriented parallel to the cutting plane of the machine and turned about a perpendicular axis (normal to the cutting plane), so as to minimize the cutting length. This determination is made mathematically from measurements taken to determine the geometric error of the single crystal relative to the crystal lattice, including requirements of the subsequent process relative to the crystal axes. The mounting of the single crystal on the support is done with a positioning device which permits exact measurement of the geometric angles of rotation of the single crystal, and mounting it as it is on a cutting support which is an indexable member belonging to the cutting machine. The single crystal can be clamped or preferably cemented on the support, which support once transferred to the cutting machine will give perfect preorientation to a single crystal ready to be sawed without subsequent adjustment. Moreover, the precision of cutting will be independent of the machine used or of the operator in the case of production lines.

The positioning device is in the form of a table or frame with a rotatable plate having its rotational axis z'" vertical, on which is positioned the single crystal support to which it will be ultimately secured. This support has an indexing system identical to that of the cutting machine. The single crystal support is an interfacial member between the positioning device and the cutting machine. It will thus have the same position on the positioning device and on the cutting machine. Above the rotatable plate but fixed relative to the table, is a mechanism permitting holding the single crystal and causing it to turn about its horizontal axis x. This system is comprised in the case of cylindrical single crystals, of two cylinders on which the single crystal rests. The single crystal can then turn about its x axis. The movement of the plate and the rotation x of the single crystal permit positioning it with no matter which orientation. The value of the two angles of rotation will be determined by the requirements of the final product and calculated mathematically. Once these two rotations take place, a mechanism brings together the support with the single crystal itself whilst maintaining their relative position. This can take place either by raising the rotatable platform or by lowering the single crystal. Once placed into contact, the single crystal will be gripped or cemented in position. The single crystal support can then be transferred to the cutting machine. The single crystal is then oriented, ready to be cut. The angles of rotation about x and z'" are measured by integrated electronic devices such as encoders or vernier devices, for example.

Figure 1:
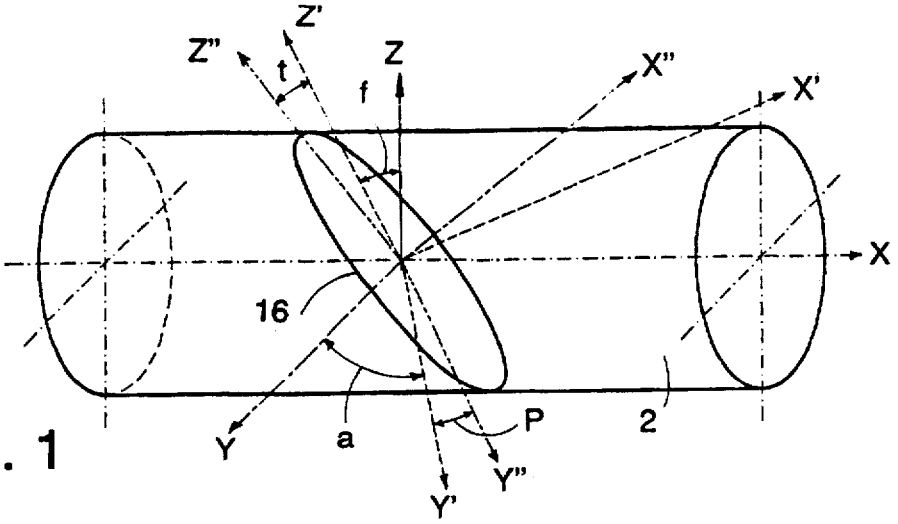
FIG. 1 shows in perspective an example of single crystal with its geometric and crystalographic axes and the selected cutting plane.

FIG. 1 shows an example of single crystal 2 to be cut, which has a cylindrical geometric shape with geometric axes x, y, z, the x axis being the principal axis. The axes x', y', z' of the crystal lattice of this single crystal are not parallel to the geometric axes. The angles a and f between the axes y',y and z',z are determined by optical or X-ray measurement and generally define the error of production of the single crystal. FIG. 1 also shows the cutting plane 16 selected or imposed on the single crystal with its axes y" and z" inclined at angles p and t relative to the axes y', z' of the crystal lattice and of the normal x" to the cutting plane. The angular values p and t are generally defined as a function of the requirements of the ultimate use of the cut-off single crystal. Of course these angles p and t could for example be equal to zero in the case in which it is desired to obtain silica plates cut parallel to the plane (100).

Figure 2A:
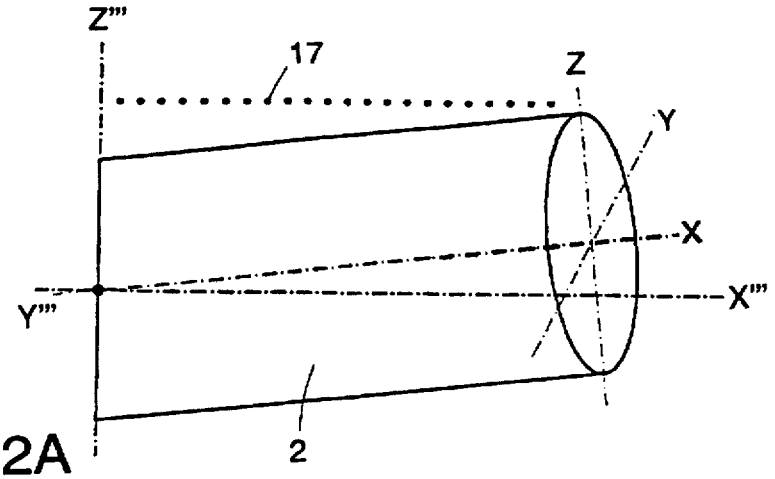
FIG. 2A PRIOR ART
FIGS. 2A and 2B show in two orthogonal views, the position of the single crystal obtained by a known process currently used.
Figure 2B:
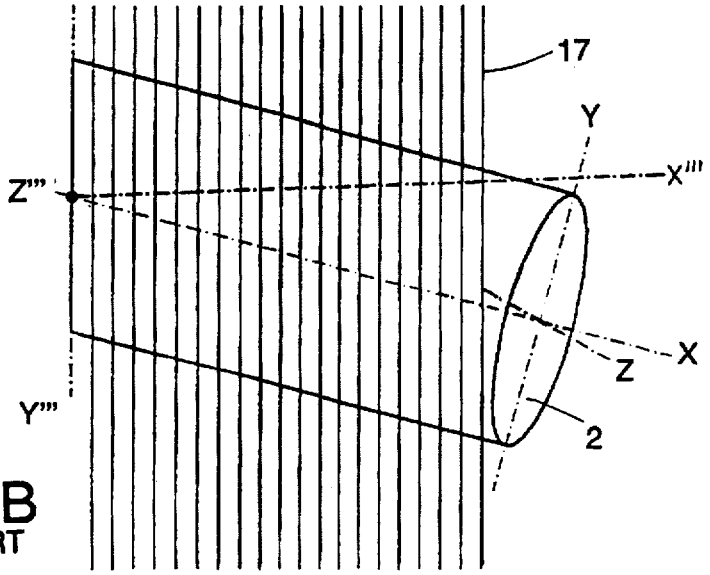
FIG. 2B PRIOR ART

FIGS. 2A and 2B show in side view and in plan, the position of the single crystal 2 obtained by the known process and currently used before the present invention to effect an orientation of the single crystal by rotation about the geometric axes y and z. The single crystal 2 is then not parallel to the plane of the wire 17 in the case of the use of a wire saw as the cutting means. The machine plane x'", y'" of the cutting machine is not parallel to the geometric axis x of the single crystal 1. The direction of advance z'" of the wire 17 is not perpendicular to the single crystal, which militates against the quality of the cut.

FIGS. 3A and 3B show the orientation of the single crystal obtained by the process according to the present invention by effecting an orientation of the single crystal by rotation about the geometric axes x and z'". The wire 17 of the saw used as cutting machine is located in the plane x'", y'" and the geometric axis x of the single crystal is parallel to this plane x'", y'". The single crystal is thus located in an optimum position relative to the cutting means, so as to obtain a very precise cut.

Figure 4:
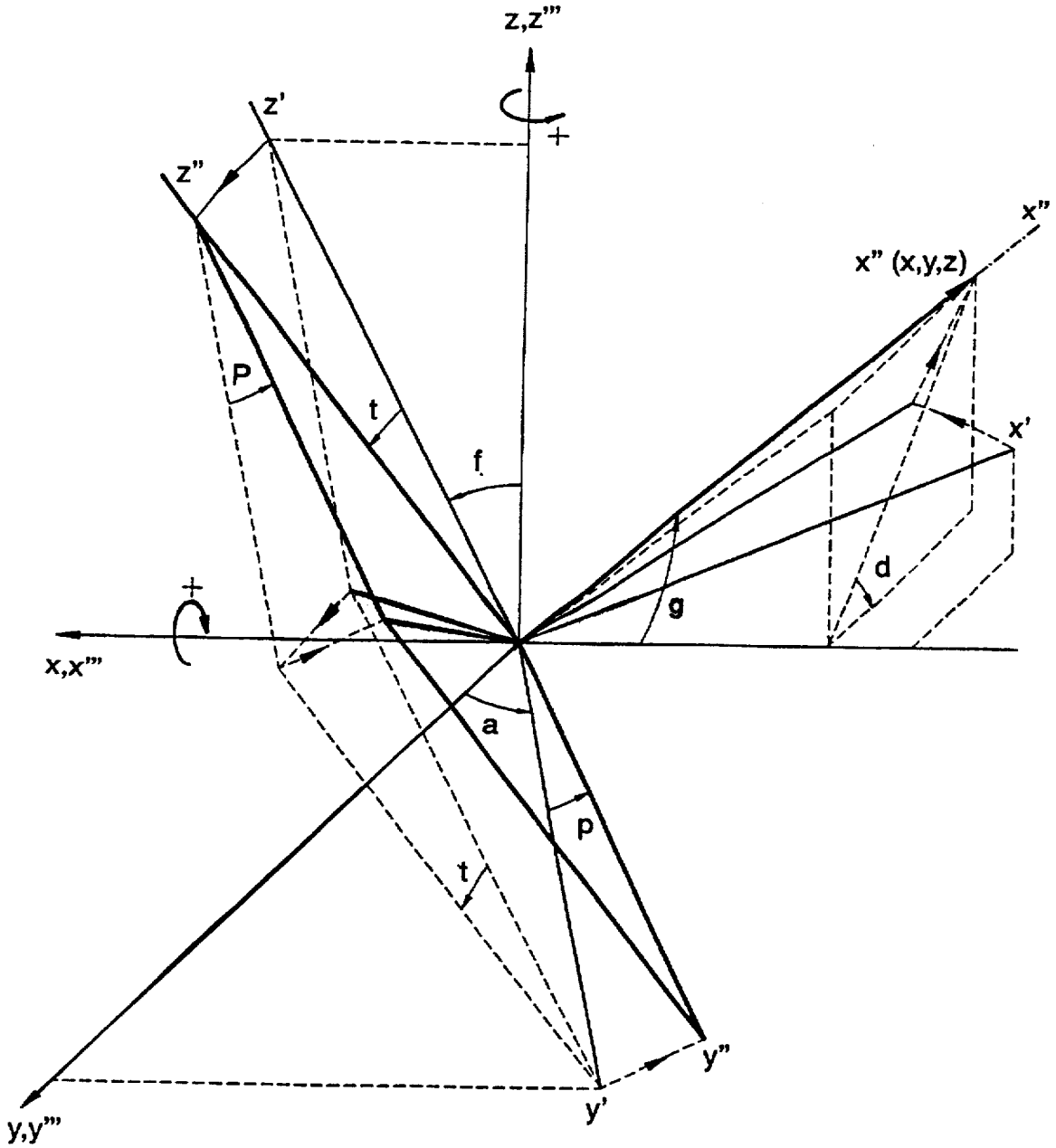
FIG. 4 is a vector diagram of the different references used.

The vector diagram of the various references used for the positioning is represented in FIG. 4 and comprises the reference x, y, z relating to the geometric shape of the single crystal, the reference x', y', z' relating to the crystal lattice of the single crystal, the reference x", y", z" relative to the cutting plane of the single crystal and the reference x'", y'", z'" used for the positioning device and the cutting machine.

The cutting plane corresponds to the plane y", z" and its normal corresponds to the direction x". The error in alignment of the geometric shape of the single crystal 2 with the crystal lattice is determined by the angles a and f, corresponding to the angles y'y and z'z. The angles p and t corresponding to the angles y"y' and z"z' determine the orientation of the selected cutting planes relative to the reference of the crystal lattice. The normal x" to the cutting plane y", z" defines a vector X"(x,y,z) which forms an angle g with the geometric axis x and the projection of the vector X"(x,y,z) on the plane y,z makes an angle d with y.

The angle d thus corresponds to the angle of rotation about the geometric axis x to bring the normal x" to the cutting plane y",z" into a reference plane corresponding to the working plane x'",y'" of the machine.

The angle g corresponds to the angle of rotation about the vertical axis z'" such that the normal x" to the cutting plane will be oriented in a reference direction corresponding to the normal x'" to the cutting plane y'"z'" of the machine to cause the desired cutting plane to coincide with the cutting plane of the cutting machine.

The angles d and g can be calculated and the mathematical solution takes the following form:

$$X'=M(a,f)X$$

wherein M(a,f) is the matrix of rotation for the angles a,f and $$X''=M(t,p)X'$$

wherein M(t,p) is the matrix of rotation for the angles p,t.

It will be seen that the two angles d and g which are given to the geometric single crystal according to x and z'" will be obtained by the components X"x, X"y, X"z of X"(x,y,z) in the reference x'", y'", z'" wherein X" is the vector normal to the plane y",z" in the referential machine.

$$d=\arctan(X''z/X''y)$$

$$g=\arctan((sqrt(X''y2+X''z2))/X''x)$$

Figure 5A:
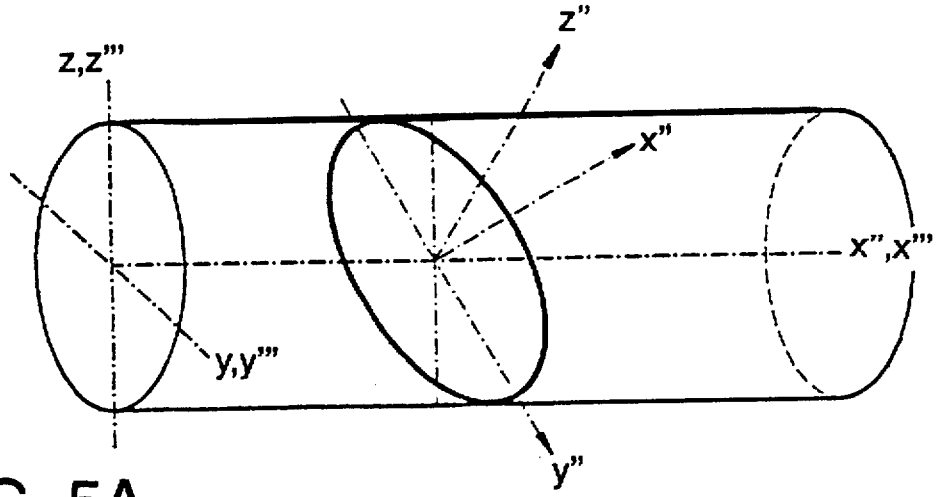
FIGS. 5A, 5B, 5C show positions occupied by the single crystal following the orientation process according to the invention.
Figure 5B:
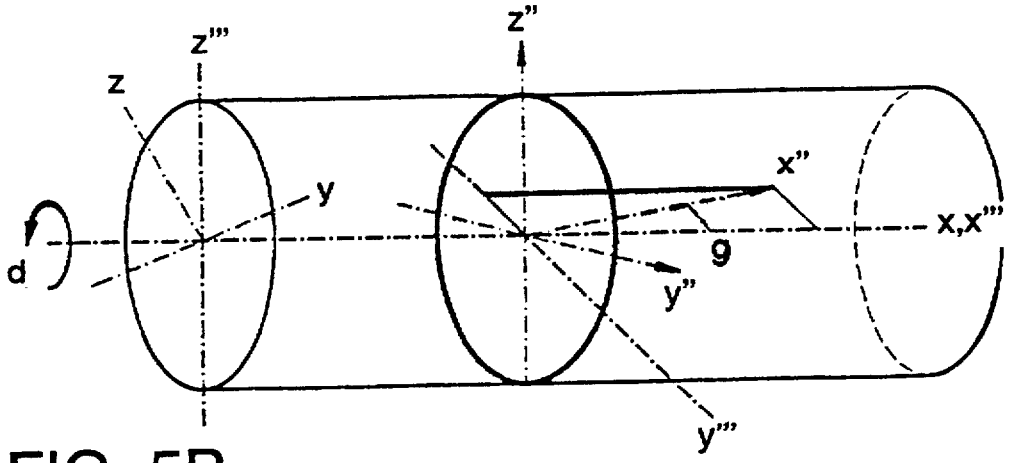
Figure 5C:
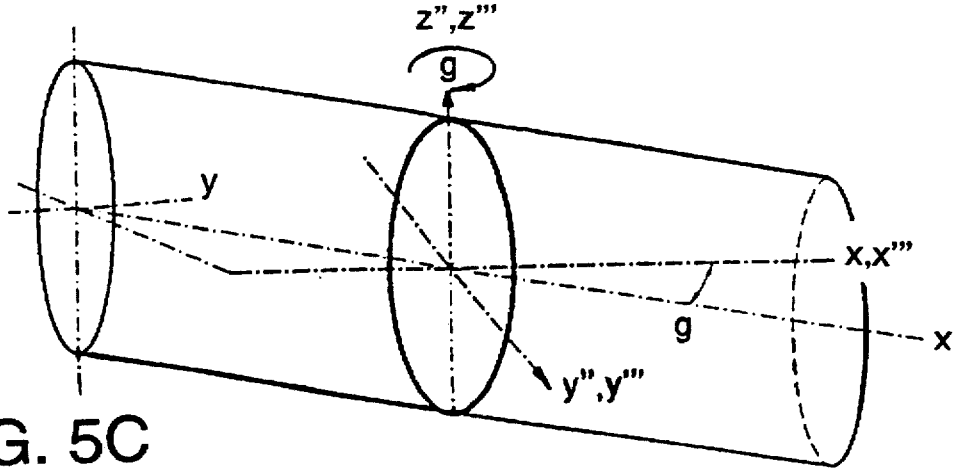

The positioning process to obtain the optimum orientation shown in FIGS. 3A and 3B is described more precisely with respect to FIGS. 5A, 5B and 5C showing three successive positions. In FIG. 5A, the single crystal is disposed on the positioning device and its geometric axes x,y,z are aligned with the axes x'",y'",z'" of the alignment device and of the cutting machine.

Figure 6:
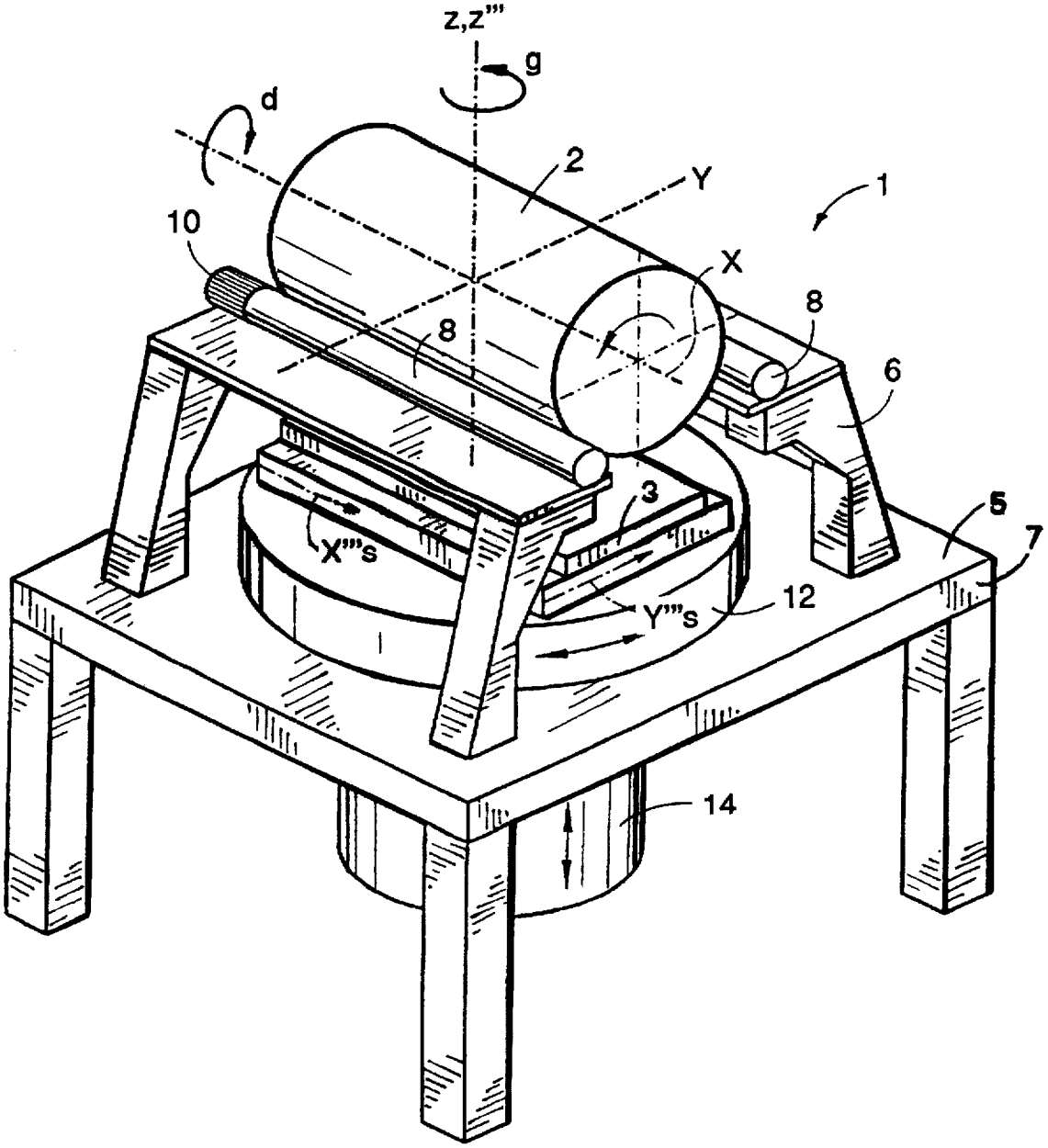
FIG. 6 is a perspective view of an embodiment of the device to practice the process.

There is then effected a rotation about the geometric axis X" or x of the angular value d to bring the vector X" into the plane x'",y'" (FIG. 5B). A rotation through an angle g of the geometric single crystal about the axis z'" brings the vector X" into a position which is colinear with the axis x'" (FIG. 5C). After these two rotations, the geometric single crystal x,y,z is oriented parallel to the plane x'",y'" with an angle g relative to the normal X" to the cutting plane corresponding to the requirements of the process ultimately used. The resulting sawing will then have the angles t and p relative to the crystalographic axes y' and z'. Of course the second rotation could also be effected by turning the cutting support through an angle -g, the single crystal remaining immovable as is done in the embodiment shown in FIG. 6.

This latter is constituted by a positioning device 1 which permits orienting the single crystal 2 outside the cutting machine according to a predetermined orientation relative to a cutting support in the form of a support 3 to which the single crystal will be secured after suitable orientation. The positioning device 1 comprises for this purpose a table or frame 5 with an upper portion 6 and a lower portion 7.

The single crystal 2 is carried by two support cylinders 8 rotatably mounted on the upper portion 6 with their principal axis oriented parallel to the axis x. An angular measurement member, in the form of an encoder 10 permits measuring the angle of rotation d of the single crystal about the axis x.

A rotatable plate 12 is rotatably mounted about the axis z'" on the lower portion 7 of the frame. An angular measurement system integrated into the rotatable plate 12 permits measuring the angle of rotation g about the axis z'". The support 3 is maintained in a precisely predetermined orientation on the rotatable plate 12.

The rotatable plate 12 is also mounted slidably in the direction z'" on the lower portion 7 of the chassis so as to be able to approach the support 3 of the single crystal 2 by means of a lever mechanism 14 to secure the single crystal 2 on the support 3. After securement, the support 3 and the single crystal 2 can be disposed in the cutting machine in a geometric position predetermined such that the reference plane $x'''_s$,$y'''_s$ of the support 3 corresponds to the working plane x'",y'" of the cutting machine and such that the perpendicular x'" to the cutting plane of the machine will be parallel to the reference direction $x'''_s$ of the support.

Thus the process and the device described permit the positioning of a single crystal on a support outside the cutting machine such that the single crystal, once mounted on its support on a cutting machine, will be cut off with a given orientation of the crystal axes relative to the sawing plane. Moreover, the position of a cylindrical single crystal is such that the generatrices of this latter will be disposed parallel to the plane of wire 17 in the case of a wire saw or parallel to the direction of movement defining the thickness of the slices if cutting off is effected with a cam. For this, the orientation of the crystal lattice is measured relative to the geometric shape of the single crystal, optically or by X-rays. The positioning device or the cutting device can to this end preferably be arranged to be adapted to be mounted on an X-ray machine such that the position of the single crystal can be controlled and effectuated simultaneously. The orientation of the cutting plane y",z" relative to the crystal lattice x',y',z' being dictated by the ultimate use, the values of the two angles of rotation of the single crystal d about the axis x and g about the axis z''' of the positioning device are determined mathematically. Once the two rotations are carried out according to the calculated values, the single crystal will be located in the desired position for the cutting machine, namely perpendicular to the cutting direction having moreover its cutting plane parallel to that of the machine. The positioning device permits the securement of the single crystal either by gripping or by cementing on a support preindexed relative to the cutting machine. Moreover, the orientation given by the process minimizes, in the case of cylindrical single crystals, the cutting length. The cutting machine therefore requires no adjustment device to ensure cutting according to angular specifications required after transfer of the single crystal on its cutting support and of the latter into the cutting machine. The plane of the wire of a wire saw remains parallel to the geometry of the single crystal during all the cutting whilst ensuring suitable orientation of the slices thus produced. Similarly, the saw blade of a bladed machine remains perpendicular to the single crystal.

Of course the embodiment described above is in no way limiting and can be the subject of any desired modification. In particular, the two angles of rotation about the axes x and z''' could be replaced by angles measured and computed relative to other geometric and crystallographic references, but which lead to the same result that the normal to the cutting plane of the single crystal is oriented in a reference direction corresponding to the normal to the cutting plane of the machine and that a predetermined geometrical axis of the single crystal and the normal to the cutting plane lie within a reference plane corresponding to the working plane of the machine. Similarly, the cutting plane can be determined by other angles than p and t relative to the crystal lattice and the offset of the crystal lattice relative to the geometric shape of the single crystal could be indicated by other angular measurements than a and f.

The two support cylinders 8 could be replaced by other means to support the single crystal and to effect a rotation of the single crystal, such as for example a single support in or on which the single crystal is temporarily secured and which is rotatably mounted on the table or the frame. This rotation support could be arranged at one or two opposite ends of the single crystal. The relative rotation between the single crystal and the cutting support about the axis z''' could also be obtained by effecting rotation of the single crystal relative to the cutting support which would remain motionless on the table or the frame of the positioning device. The rotatable plate would then be replaced by a member rotatable along z''' and carrying the temporary support for the single crystal.

The angular measurement devices could be electronic, optical or mechanical.

The approach or the contact of the single crystal with the cutting support could be effected upwardly or downwardly and by displacing either the cutting support or the single crystal.

Rotation about the two horizontal and vertical axes x,z''' could be reversed in time by carrying out first the rotation about the axis z''' and then the rotation about the horizontal axis x.

The process and device could also be used for oriented cutting of single crystals of any other geometric shape or of any other material than a single crystal, such as polycrystalline agglomerations with predetermined crystalline orientation, single twined crystals or polysynthetic crystals, oriented crystalline aggregates, alloys, oriented crystalline substances contained in amorphic substances, for example polarizing materials.

I claim:

1. A process for orienting a single crystal in a cutting machine along a predetermined cutting plane (y'', z'') by means of a positioning device outside the cutting machine according to a predetermined orientation relative to a cutting support, the process comprising the steps of:

positioning the single crystal on support and rotating means of the positioning device, the support and rotating means being adapted to rotate the single crystal through an angle of at least 180° about a first axis of rotation included in a reference plane corresponding to a working plane (x''', y''') of the cutting machine perpendicular to its sawing plane (y''', z''') and adapted to support the crystal in such a manner that a geometric axes (x) corresponding to the principal axis of elongation of a geometric shape (x, y, z) of the single crystal corresponds with said first axis of rotation;

determining the orientation of the cutting plane (y'', z'') of the single crystal relative to the crystal lattice axes (x',y',z');

determining the orientation of the crystal lattice axes (x',y',z') relative to the geometric shape axes (x, y, z,) of the single crystal;

determining first and second angles of rotation (d, g) having regard for the orientation of the cutting plane (y'', z'') relative to the crystal lattice axes (x', y', z') and relative to the geometric shape axes (x, y, z) of the single crystal;

rotating the single crystal through said first angle (d) about said geometric axis (x) to bring the normal (x'') to the cutting plane (y'', z'') of the single crystal into said reference plane;

effecting a relative rotation between the cutting support and the single crystal through said second angle (g) about a second axis (z''') perpendicular to said reference plane such that the normal (x'') to the cutting plane (y'', z'') will be oriented in a reference direction corresponding to the normal to the sawing plane (y''', z''') of the machine, said geometric axis (x) and the normal (x'') to the cutting plane of the single crystal (2) lying in said reference plane, such that the single crystal may be secured with its principal axes of elongation parallel to the cutting support;

securing the single crystal in said predetermined orientation on the cutting support whose emplacement in the cutting machine is geometrically defined relative to the sawing plane (y''', z''') of the machine; and placing the cutting support after securement of the single crystal thereto, in the cutting machine to obtain said predetermined orientation of the single crystal in the cutting machine.

2. A process according to claim 1, further comprising the step of determining the orientation of the crystal lattice axes (x', y', z') relative to the geometric shape axes (x, y, z) optically or by means of X-rays.

3. A process according to claim 1, wherein the single crystal is substantially cylindrical, and further comprising the step of placing the single crystal two parallel rotatable cylinders forming said support and rotating means of the positioning device, the axes of the two cylinders being parallel to said reference plane.

4. A device for orienting a single crystal for a cutting machine, comprising a positioning device with a cutting support, the positioning device adapted to orient the single crystal outside the cutting machine according to a predetermined orientation relative to the cutting support to which the single crystal is adapted to be secured the cutting support's emplacement in the cutting machine being geometrically defined and principal axes ($X'''_s$, $Y'''_s$) being parallel to the axes (X''', Y''') of a working plane of the cutting machine, said positioning device comprising:

first support and rotating means adapted to effect a rotation of the single crystal through an angle of at least 180° about a first axis of rotation included in a reference plane corresponding to the working plane (x''', y''') of the cutting machine perpendicular to its sawing plane (y''', z''') and adapted to support the crystal in such a manner that a geometric axis (x) corresponding to the principal axis of elongation of the geometric shape (x, y, z) of crystal corresponds with said first axis of rotation;

a first angular measurement member adapted to determine a first predetermined angle of rotation (d) of the single crystal about said geometric axis (x) to bring a normal (x") to a cutting plane (y", z") of the single crystal into said reference plane;

second rotating means to effect a relative rotation between the cutting support and the single crystal about an axis (z''') perpendicular to said reference plane;

a second angular measurement member adapted to determine a second predetermined angle of rotation (g) about said axis (z''') to orient said normal (x") in a reference direction corresponding to the normal to the sawing plane (y''', z''') of the machine; and third means to effect a relative translatory movement between the single crystal and the cutting support adapted to bring together the cutting support and the single crystal so as to secure the single crystal on the cutting support in said predetermined orientation, in which its principal axis of elongation is parallel to the cutting support.

5. A device according to claim 4, wherein said first support and rotating means comprise two parallel cylindrical support rotatably mounted on a frame of the positioning device and arranged so as to support the single crystal.

6. A device according to claim 4, wherein said second rotating means comprise a rotatable plate mounted rotatably relative to said frame and whose principal plane is parallel to said axes of said cylindrical supports, this rotatable plate being arranged to maintain the cutting support in a predetermined geometric position, said third means comprise a translatory mechanism permitting bringing together the cutting support and the single crystal and the cutting support which is so shaped that its positioning within the cutting machine is effected according to a geometric position corresponding to the predetermined geometric position on said rotatable plate such that the reference plane and the reference direction correspond to the working plane (x''', y''') and to the normal (x''') to the cutting plane of the machine.

7. A device according to claim 4, wherein the cutting support or the positioning device are adapted to be mounted on a X-ray generator.

* * * * *